US007496003B2

(12) United States Patent
Müller

(10) Patent No.: US 7,496,003 B2
(45) Date of Patent: Feb. 24, 2009

(54) ANALOGUE DISPLAY DEVICE FOR A TIMEPIECE

(75) Inventor: Francesco Müller, Genthod (CH)

(73) Assignee: Franck Müller Watchland S.A. (CH)

( * ) Notice: Subject to any disclaimer, the term of this patent is extended or adjusted under 35 U.S.C. 154(b) by 0 days.

(21) Appl. No.: 10/525,281

(22) PCT Filed: Aug. 11, 2003

(86) PCT No.: PCT/EP03/08906

§ 371 (c)(1),
(2), (4) Date: Feb. 17, 2005

(87) PCT Pub. No.: WO2004/019140

PCT Pub. Date: Mar. 4, 2004

(65) Prior Publication Data

US 2005/0259519 A1 Nov. 24, 2005

(30) Foreign Application Priority Data

Aug. 23, 2002 (CH) ..... 1446/02

(51) Int. Cl.
*G04B 19/04* (2006.01)

(52) U.S. Cl. ..... 368/228; 368/80; 368/223

(58) Field of Classification Search ..... 368/76, 368/80, 220, 221, 223–238
See application file for complete search history.

(56) References Cited

U.S. PATENT DOCUMENTS 4,659,232 A * 4/1987 Coster et al. ..... 368/223
4,833,661 A 5/1989 Kim ..... 368/80
5,051,967 A * 9/1991 Dismond, III ..... 368/62

FOREIGN PATENT DOCUMENTS

DE 24 55 170 A1 4/1976

OTHER PUBLICATIONS

International Preliminary Examination Report for International Application No. PCT/EP2003/008906.

* cited by examiner

*Primary Examiner*—Edwin A. Leon
*Assistant Examiner*—Thanh S Phan
(74) *Attorney, Agent, or Firm*—Ostrolenk, Faber, Gerb & Soffen, LLP

(57) ABSTRACT

The invention relates to an analogue display device for a timepiece. The inventive device consists of display means which are disposed such as to perform jumps in relation to a dial comprising a haphazard series of values to be displayed.

16 Claims, 5 Drawing Sheets

ANALOGUE DISPLAY DEVICE FOR A TIMEPIECE

CROSS REFERENCE TO RELATED APPLICATION

Figure 1:
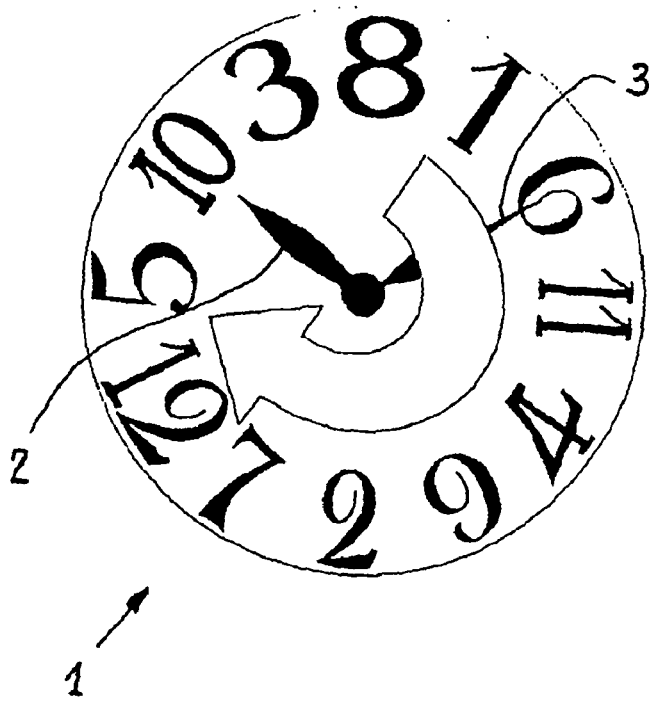

The present application is a 35 U.S.C. § 371 national phase conversion of PCT/EP2003/008906 filed 11 Aug. 2003, which claims priority of Swiss Application No. 1446/02 filed 23 Aug. 2002.

The PCT International Application was published in the French language.

The object of the invention is an analogue display device for a timepiece.

In conventional watches, the hour is indicated by means of a hand known as the hour hand. This hand has a pivot point more often than not placed in the centre of the dial and, as a general rule, it carries out a complete rotation in twelve hours, passing successively from one hour to the next at a regular speed in sixty minutes in an anti-trigonometric direction.

The aim of the invention is to propose a "trompe-l'oeil" display characterized by the jumbled alignment of the numbers, with the hour hand having to jump between one number and the next.

The analogue display device for a timepiece according to the invention is characterized in that it comprises display means arranged to make jumps relative to a dial having a jumbled sequence of the values to be displayed.

The values to be displayed on the dial are offset on the dial in a clockwise or anti-clockwise direction. The successive values to be displayed are offset by a certain number of successive positions in the sequence of the values.

The offset is five, seven or thirteen successive positions. In a preferred embodiment, the dial displays the time by means of hands.

According to another embodiment, the display means are discs placed underneath the dial, with the latter having cut-outs to reveal the values displayed on the discs.

The device may be adapted to display values that are hours and minutes, dates, names of days, weeks, phases of the moon, etc.

According to a first embodiment, the analogue display device comprises a control mechanism having a winding wheel attached to an impulse wheel, driven by an impulse spring, which propels the impulse wheel in an anti-clockwise direction following the tensioning of the spring by a truncated cannon-pinion attached to the cannon-pinion that completes one rotation per hour.

According to a second embodiment, the analogue display device according to the invention comprises a control mechanism having a rack connected to the minute pinion, and a rack connected to the hour wheel, the minute rack being guided by a snail mounted on a return wheel driven by the standard cannon-pinion of the movement, the rack dropping into the cut-away section of the snail after a complete rotation of the snail, and driving the minute pinion and the hour wheel as it drops, thus allowing for the jump from one hour to the next.

The drawing shows, as an example, two embodiments of the analogue display device for hours or other information (days, dates, etc.) for a timepiece, which is the object of the invention.

Figure 2:
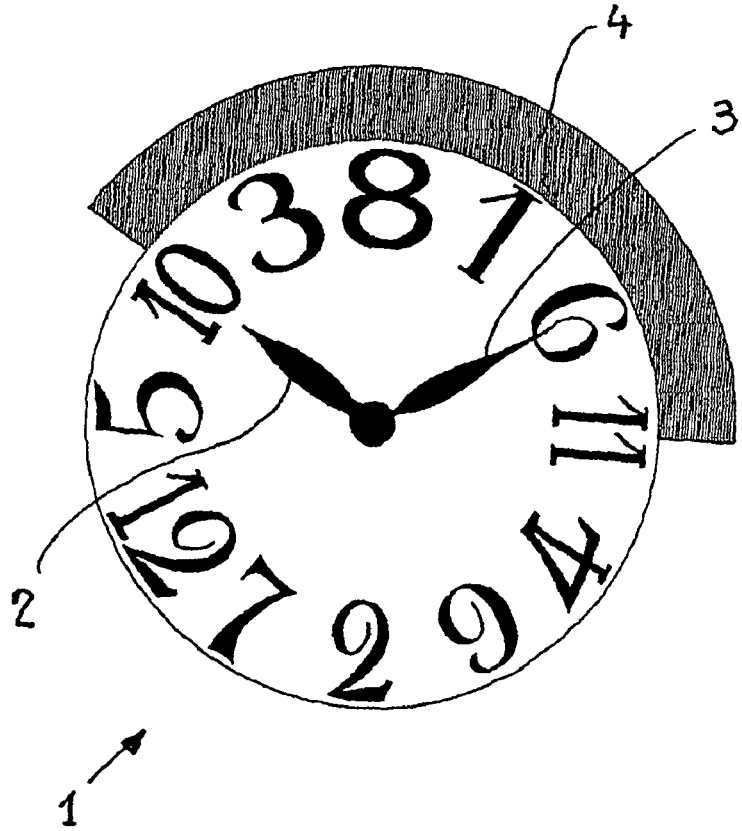
Figure 3:
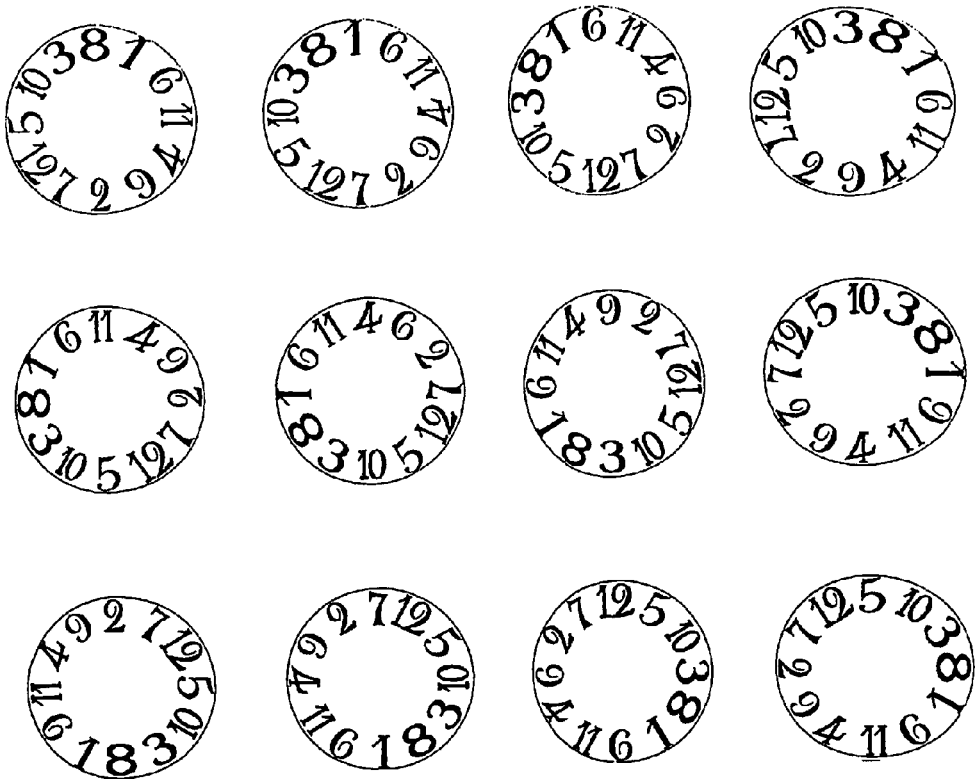
Figure 5:
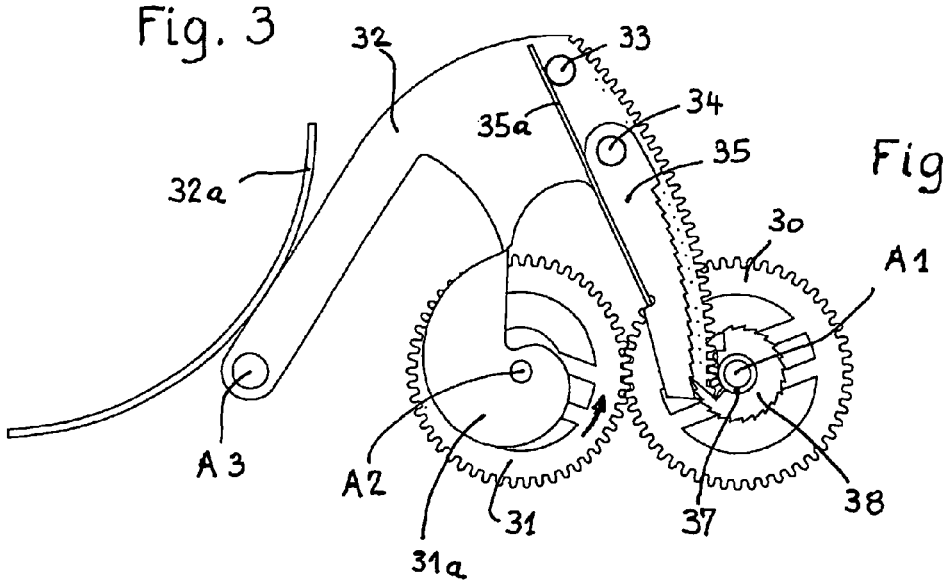
Figure 7:
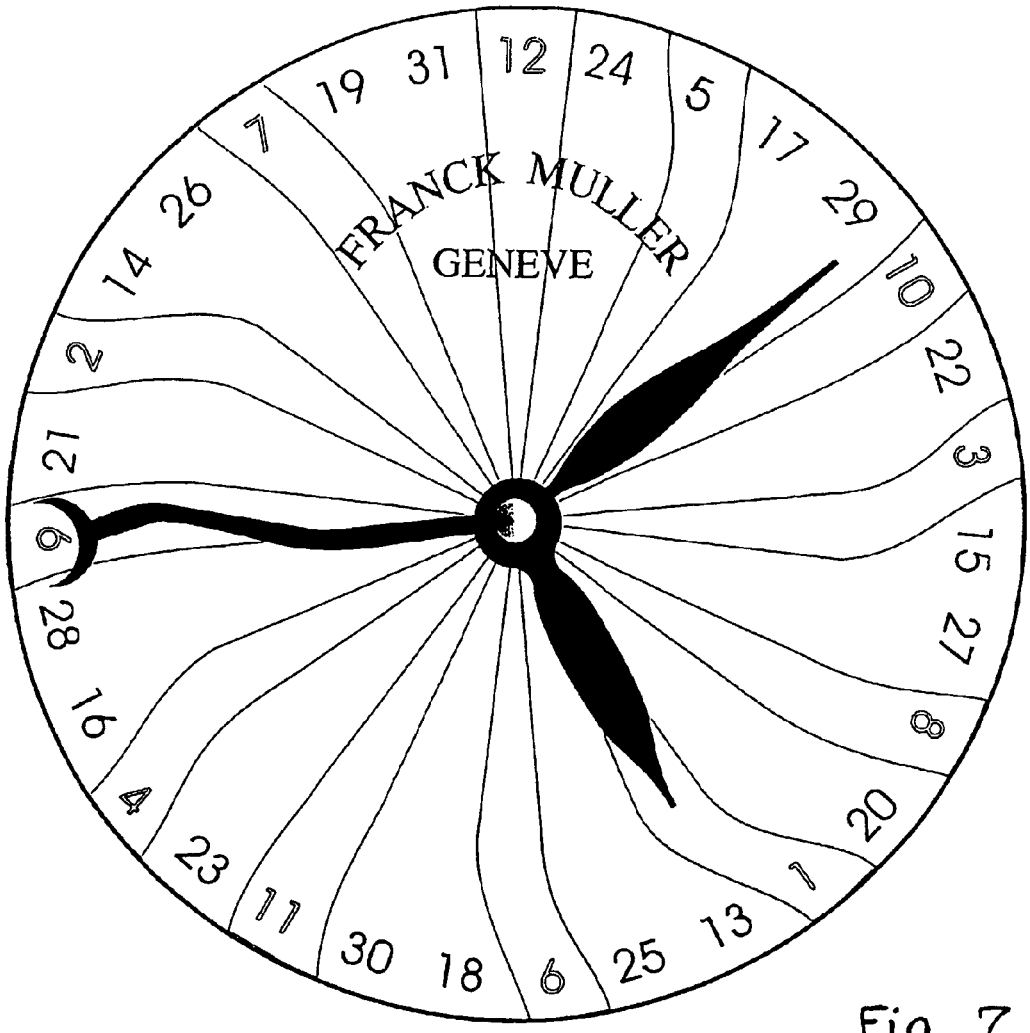
Figure 6:
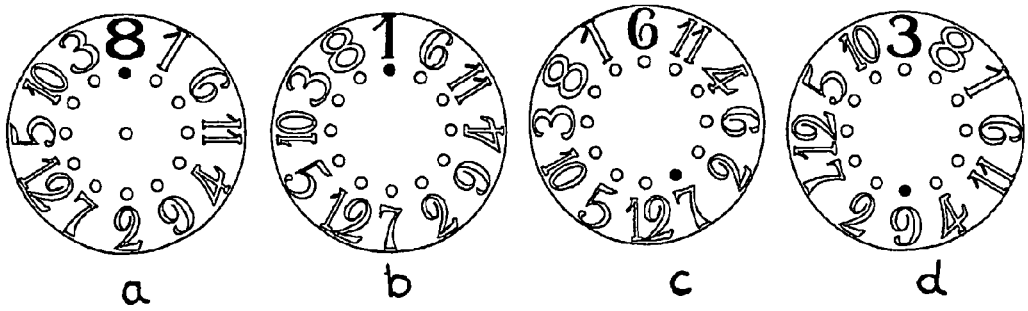

In the drawing:

FIG. 1 is a view of the dial and the hands of the device,

FIG. 2 is a similar view to the view in FIG. 1, showing a sector of passing from one hour to the next, FIG. 3 shows the twelve possible layouts of the numbers to indicate the time by carrying out 30° rotations depending on the number to be highlighted on the standard midday/midnight position, FIG. 4 is a view of the first embodiment of a control mechanism in its successive operating phases a, b, c and d, FIG. 5 is a view of the second embodiment of the control mechanism of the device in its position before the rack drops and the hour hand jumps, FIG. 6 is a view of a display of the device by means of discs located underneath the dial, and FIG. 7 is a view of a display of the device indicating the date.

In conventional watches, the hour is indicated by means of a hand known as the hour hand. This hand has a pivot point more often than not placed in the centre of the dial. As a general rule, it carries out a complete rotation in twelve hours, passing from one hour to the next at a regular speed, in sixty minutes, in an anti-trigonometric direction.

The analogue display device shown in the drawing differs from conventional watches firstly in its "trompe-l'oeil" display, that is, in the jumbled alignment of the numbers, and secondly in the jumps made by the hour hand.

As shown in FIG. 1, the device comprises a dial 1, an hour hand 2 and a minute hand 3, having a coincident pivot point at the centre of the dial 1, as on conventional watches.

The minute hand 3 follows a standard trajectory, and indicates the minutes in a normal way.

The hour hand 2 does not carry out a complete rotation around the dial in twelve hours, but moves from one hour to the next by instantaneous jumps in a clockwise (anti-trigonometric) direction.

It follows the jumbled order of the numbers (ascending) despite their erratic alignment.

Its specific feature is that it remains fixed (without moving) on the corresponding hour throughout the entire journey of the minute hand, and only moves when the time passes on to the next hour, jumping five numbers out of twelve.

The path of the hour hand 2 from one hour to the next is 150° or five hour indications in an anti-trigonometric direction. Furthermore, given the alignment of the numbers, the hour hand consecutively passes over the same number every twelve hours. In other words, five rotations around the dial are needed to come back to the same number.

The hour hand travels twelve times 150°, that is 1,800°, or five times 360°.

The order of the numbers is not random, but corresponds each time to an angle or sector 4 (FIG. 2) with an interval of 150° (i.e. 5 numbers). Each time the next ascending number is located 5 numbers away, always in a clockwise direction.

With this invention, it is possible to vary the layout of the numbers by rotating the numbers by 30° or several times 30°, depending on the number to be highlighted, on the "standard twelve o'clock" position.

For a dial showing twelve hours, there are therefore twelve possibilities, which are shown in FIG. 3.

The first embodiment of the analogue display device in FIGS. 1 to 3 comprises a control mechanism the operation of which is described with reference to FIGS. 4*a*, 4*b*, 4*c* and 4*d*. In this mechanism:

A truncated cannon-pinion 10 is fitted securely to the standard cannon-pinion 11 of a conventional movement, that is, the truncated cannon-pinion completes one rotation in one hour. The minute hand is fitted securely to the cannon-pinion 11 as normal. In this way, the minute hand indicates the minutes in a standard manner.

The hour wheel 12 is fitted freely and is co-axial with the cannon-pinion 11. It can rotate freely on its rotary staff A1 without driving the cannon-pinion 11.

The hour hand is fitted securely to the hour wheel 12 as in a standard movement. The hour wheel 12 has the specific feature of having twelve teeth that serve, amongst other things, to always position it so that the hour hand is in line with the hour marker on the dial by means of the hour jumper 13 that angularly positions the hour wheel 12.

A pivot pin 14 attached securely to the module plate is fixed co-axially with the staff A2.

An impulse wheel 15 forms part of an assembly 16 of four components: the winding wheel 17, the impulse wheel 15, and two positioning pins 18 and 19. The two positioning pins 18 and 19 have a dual function; firstly, they secure the winding wheel 17 and the impulse wheel 15 to each other because they are pushed into both parts, and secondly they extend above the impulse wheel 15 and act as a point of contact with the impulse spring 20.

The impulse spring 20 and the hour jumper 13 are spring leaves secured to the module plate by any means. In this case, the spring leaves are crimped into grooves in the module plate.

The impulse spring 20 has two functions; it positions, as would a jumper, the impulse wheel 15 in its angular position, resting on two points of contact that are the two positioning pins 18 and 19. In addition, it holds the impulse wheel 15 down and prevents it from coming out of its housing.

Figure 4A:
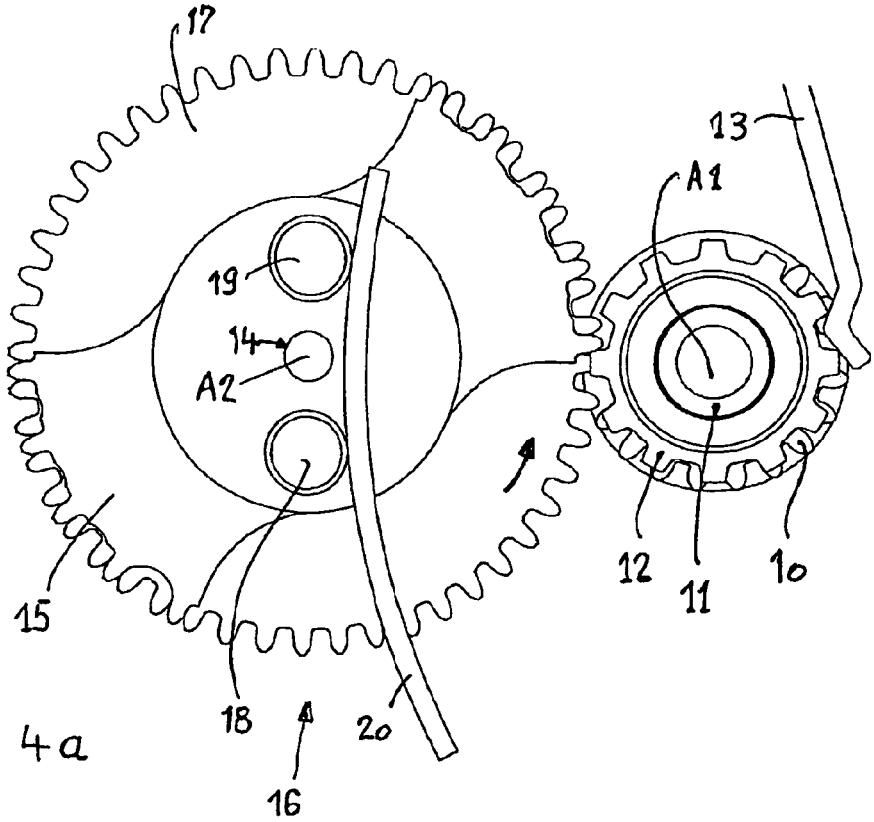

The mechanism described above operates as follows:

When the basic movement is running, the cannon-pinion 11 completes one rotation per hour. As the truncated cannon-pinion 10 is secured to the cannon-pinion 11, it rotates at the same speed. As shown in FIG. 4*a*, the truncated cannon-pinion 10 comes into contact with the winding wheel 17 by means of its teeth. The winding wheel 17 always waits for the teeth on the truncated cannon-pinion 10 in this position as the winding wheel 17 is positioned by the impulse spring resting on the two positioning pins 18 and 19.

Figure 4B:
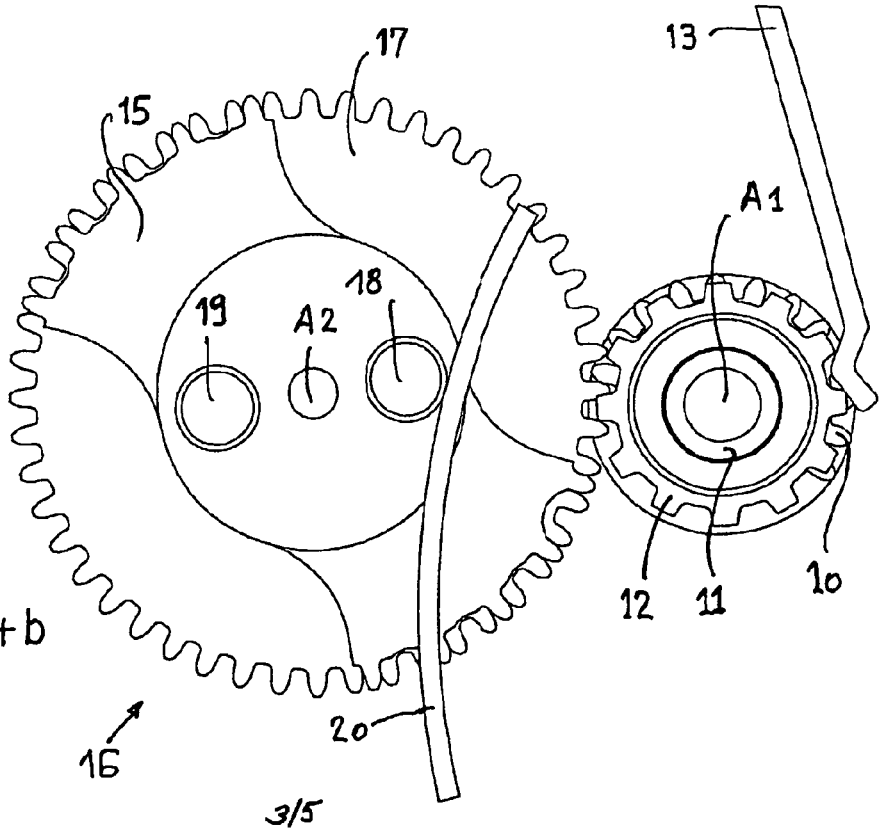
Figure 4C:
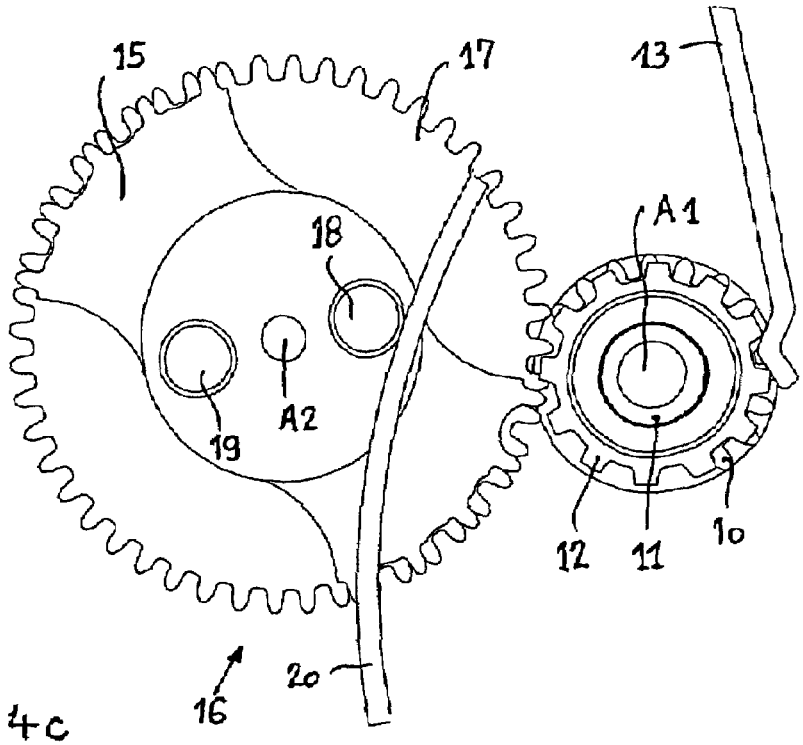
Figure 4D:
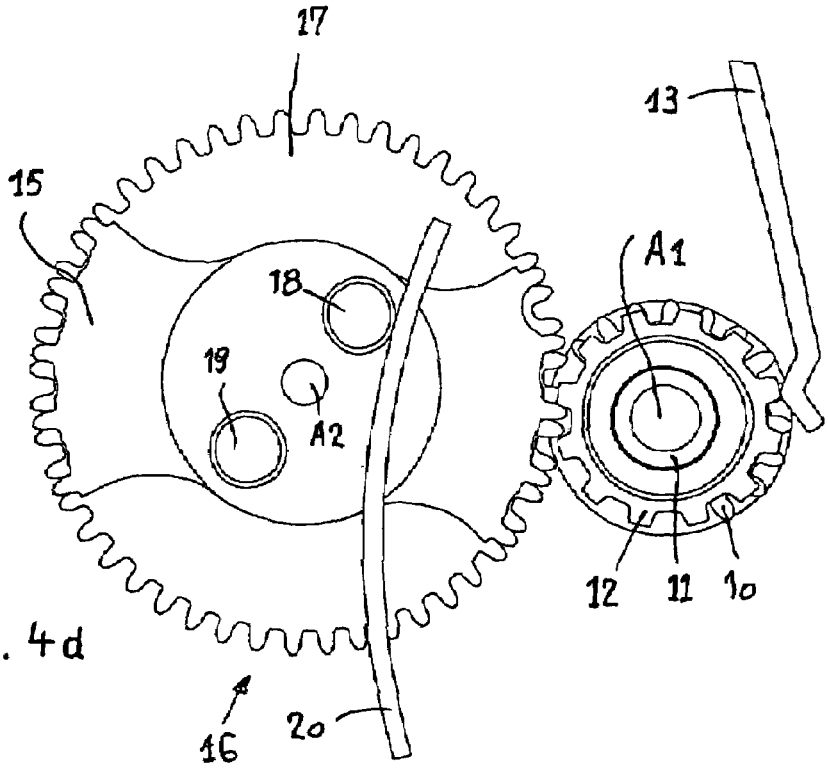

As shown in FIG. 4*b*, the truncated cannon-pinion 10 rotating in a clockwise direction drives the winding wheel 17 whilst gradually winding the impulse spring 20 until the truncated cannon-pinion 10, having no more teeth (FIG. 4*c*), releases the winding wheel 17 which, under the action of the impulse spring 20, propels the winding wheel 17 and the impulse wheel 15 in an anti-clockwise direction (FIG. 4*d*).

The jump by this assembly 16 drives the hour wheel 12 in a clockwise direction and, in the case in point, the hour wheel 12 moves on five teeth, or five times 30°, as the winding wheel 17 has two times five teeth. The impulse spring 20 repositions the assembly pivoting on the staff A2, and then the truncated cannon-pinion 10 returns to the position shown in FIG. 4*a*, and the mechanism re-starts its cycle, the impulse wheel 15 being symmetrical.

FIG. 5 of the drawings shows a second embodiment of a drive mechanism for the analogue display device comprising:

- a standard cannon-pinion 30 that completes one rotation per hour concentrically with the staff A1. This cannon-pinion meshes with a centre return wheel 31 that therefore also completes one rotation per hour, but in an anti-clockwise direction concentrically with the staff A2.
- a minute snail 31*a* is fixed securely to the centre return wheel 31. This snail 31*a* therefore carries out a complete rotation in one hour in an anti-clockwise direction.
- a minute rack 32 pivots around the staff A3 and holds two pins securely: one hour rack spring banking pin 33 and one hour rack pivot pin 34.

The hour rack 35 is mounted so that it rotates freely around the hour rack pivot pin 34.

The hour rack spring 35*a* is assembled securely on the hour rack 35. It rests against the hour rack spring banking pin 33.

The hour rack spring 35*a* is fixed securely to the bottom plate of the mechanism. It presses constantly on the side of the rack to impart movement to it that pushes it against the centre of the staff A1.

A minute pinion 37 is mounted so that it rotates freely on the staff A1 and an hour wheel 38 is mounted so that it rotates feely on the tube of the minute pinion 37.

The minute pinion 37 holds the minute hand, and the hour wheel holds the hour hand.

The minute rack 32 meshes constantly with the minute pinion 37.

The hour rack 35 meshes constantly with the hour wheel 38 when it is going in the direction of the dropping of the minute rack 32, but it draws back when the minute rack is moving up along the minute snail 31*a*.

In operation, the mechanism in FIG. 5 carries out the following operations:

the standard cannon-pinion 30 completes one rotation per hour, and drives the return wheel 31 at the same speed, but in the opposite direction. The minute rack 32, pressing constantly on the minute snail 31*a*, pushed by the minute rack spring 32*a*, moves up along the minute snail 31*a*.

When the rack is moving up along the snail, it drives the minute pinion 37 holding the minute hand, and therefore indicates the minutes.

The teeth on the minute rack 32 are calculated so that the minute pinion completes a full rotation in one hour.

The minute pinion 37 never continues its rotation, and systematically goes back after each hour jump.

When the minute rack 32 is moving up along the snail 31*a*, the hour rack 35 does not drive the hour wheel 38 as the wheel is held by a jumper. The rack disengages when it is moving up due to the shape of the teeth (dog-tooth style).

However, the rack 35 is always pushed by the hour rack spring 35*a* against the teeth on the hour wheel so that when it moves down, it can drive the hour wheel 38 in an anti-clockwise direction.

When the minute snail 31*a* has completed its full rotation, the tip of the minute rack 32 drops into the cut-away section of the snail, and comes to rest on the bottom of the minute snail.

When it drops, the minute rack drives the minute pinion 37 and the hour wheel 38.

The hour wheel thus makes a jump allowing for the passage from one hour to the next.

In FIG. 6, the analogue display device has colored discs located underneath the dial, with the discs replacing the hour and minute hands here. In this case, the dials are made in such a way that the hour and minute numbers can be seen through the dial. FIG. 6 shows four examples of indication of the time.

In FIG. 6*a*, it is 8 o'clock.

In FIG. 6*b*, it is 1 o'clock.

In FIG. 6*c*, it is twenty-five past six and

In FIG. 6*d*, it is three thirty.

Obviously, the analogue display devices described above, together with their control mechanisms, can be adapted to display other information than the time, for example the date, the days of the week, the phases of the moon, etc. The analogue display and its mechanism can also be fitted on a quartz movement.

FIG. 7 of the drawings shows a view of an analogue date display device, in which the jump made between two consecutive dates is thirteen places each time.

The invention claimed is:

1. An analogue display device for a timepiece, comprising display means arranged to jump relative to a dial having a non-sequential pattern of the values to be displayed, wherein successive values to be displayed on the dial are offset by regular intervals of a certain number of successive positions in the non-sequential pattern of the values to be displayed, the succession of values being indicated by a mechanical control mechanism operable to drive the display means, wherein the mechanical control mechanism comprises a winding wheel secured to an impulse wheel driven by an impulse spring that propels the impulse wheel in an counter-clockwise direction following the tensioning of the spring by a truncated cannon-pinion secured to the cannon-pinion and completing one rotation per hour.

2. A device according to claim 1, wherein the offset is 5, 7 or 13 successive positions.

3. A device according to claim 2, wherein the dial has 12 indications, and the offset is either 5 or 7 successive positions.

4. A device according to claim 2, wherein the dial has 31 indications, and the offset is 13 successive positions.

5. A device according to claim 1, wherein the dial displays the time by means of hands.

6. A device according to claim 1, wherein the display means are discs placed underneath the dial.

7. A device according to claim 6, wherein the dial has cut-outs to reveal the values displayed on the discs.

8. A device according to claim 1, wherein the values to be displayed are selected from the group comprising hours and minutes, dates, names of days, weeks, and phases of the moon.

9. An analogue display device for a timepiece, comprising display means arranged to jump relative to a dial having a non-sequential pattern of the values to be displayed, wherein successive values to be displayed on the dial are offset by regular intervals of a certain number of successive positions in the non-sequential pattern of the values to be displayed, the succession of values being indicated by a mechanical control mechanism operable to drive the display means, wherein the mechanical control mechanism comprises a first rack connected to a minute pinion and a second rack connected to an hour wheel the first rack being guided by a snail mounted on a return wheel driven by a standard cannon-pinion of the timepiece movement, the first rack dropping into the cut-away section of the snail after a complete rotation of the snail, and driving the minute pinion and the hour wheel, thus allowing for a jump from one hour to the next.

10. A device according to claim 9, wherein the offset is 5, 7 or 13 successive positions.

11. A device according to claim 10, wherein the dial has 12 indications, and the offset is either 5 or 7 successive positions.

12. A device according to claim 10, wherein the dial has 31 indications, and the offset is 13 successive positions.

13. A device according to claim 9, wherein the dial displays the time by means of hands.

14. A device according to claim 9, wherein the display means are discs placed underneath the dial.

15. A device according to claim 14, wherein the dial has cut-outs to reveal the values displayed on the discs.

16. A device according to claim 9, wherein the values to be displayed are selected from the group comprising hours and minutes, dates, names of days, weeks, and phases of the moon.

* * * * *